United States Patent [19]

Lotz

[11] 4,270,282

[45] Jun. 2, 1981

[54] HOUSED CLOTHES DRYER

[75] Inventor: Helmut Lotz, Giengen, Fed. Rep. of Germany

[73] Assignee: Bosch-Siemens Hausgeräte GmbH, Stuttgart, Fed. Rep. of Germany

[21] Appl. No.: 961,230

[22] Filed: Nov. 16, 1978

[30] Foreign Application Priority Data

Nov. 16, 1977 [DE] Fed. Rep. of Germany ..... 2751284

[51] Int. Cl.[3] ..... F26B 11/04

[52] U.S. Cl. ..... 34/86; 34/76; 34/35; 34/133; 165/7; 165/10

[58] Field of Search ..... 34/86, 133, 75, 76, 34/35; 165/7, 10

[56] References Cited

U.S. PATENT DOCUMENTS

| | | | |
|---|---|---|---|
| 3,190,349 | 6/1965 | Hryniszak | 165/7 |
| 3,265,119 | 8/1966 | Mittmann | 165/7 |
| 3,319,706 | 5/1967 | Kritzler et al. | 165/7 |
| 4,047,559 | 9/1977 | Asplund et al. | 165/7 |
| 4,063,587 | 12/1977 | Stockman | 165/10 |

FOREIGN PATENT DOCUMENTS

| | | | |
|---|---|---|---|
| 204817 | 12/1956 | Australia | 165/7 |
| 1410206 | 10/1968 | Fed. Rep. of Germany . | |

*Primary Examiner*—Larry I. Schwartz
*Attorney, Agent, or Firm*—Herbert L. Lerner

[57] ABSTRACT

In a housing, a clothes dryer wherein dampness in washed clothes is expelled by warm air sweeping therethrough, the air being drawn in at least partly from the environment through openings formed in the housing and heated and, after absorbing the dampness, exhausted at least partly back into the environment, the air drawn in from the environment and exhausted to the environment being conducted through two channels of a heat exchanger with a solid-body regenerator alternatingly contacted in part by the drawn-in air and the exhausted air, the improvement therein including non-hygroscopic storage material received in the regenerator and absorbing thermal energy as loss-free as possible, storing the absorbed thermal energy as loss-free as possible and subsequently surrendering the thermal energy as loss-free as possible, the regenerator being air-permeable in axial direction thereof and being mounted in the drawn-in and exhausted air channels for rotation in a manner that every region of the regenerator is alternatingly introduced into the drawn-in air channel and into the exhaust air channel during the rotation.

13 Claims, 6 Drawing Figures

Fig. 1
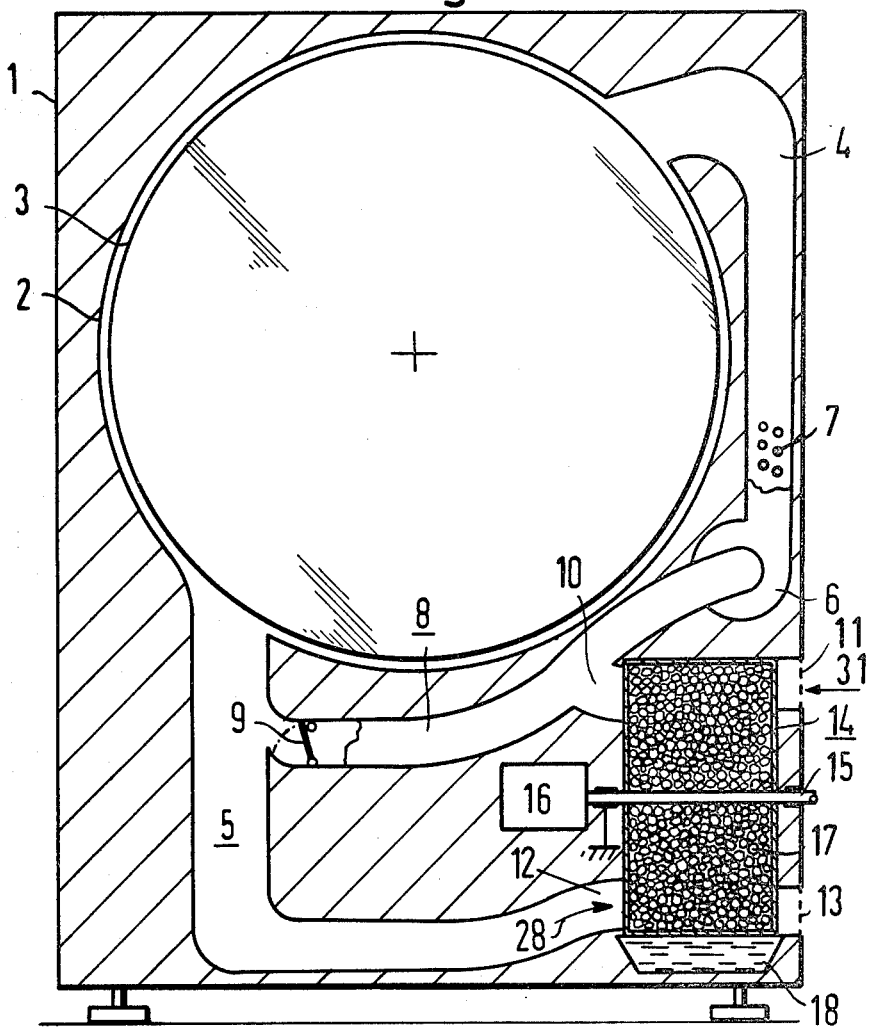
Fig. 2
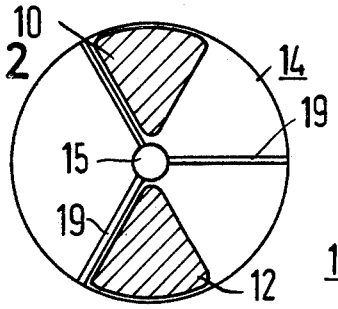
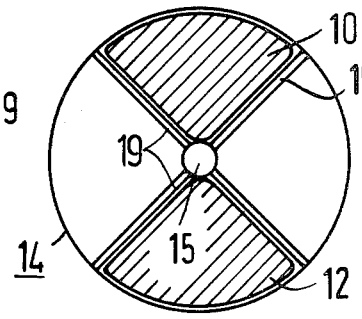
Fig. 3

HOUSED CLOTHES DRYER

The invention relates to a housed clothes dryer i.e. a clothes dryer installed in a housing, wherein moisture or dampness in washed clothes is expelled by warm air sweeping therethrough the air being drawn in at least partly from the environment and heated and, after absorbing the dampness, exhausted at least partly back into the environment, the air drawn in or supplied from the environment and the air exhausted to the environment being conducted through two channels of a heat exchanger with a solid-body regenerator alternatingly contacted in part by the drawn-in or supplied air and the exhausted air.

Such a clothes dryer has become known heretofore from German Published Non-Prosecuted Application DE-OS No. 14 10 206 wherein two hollow members formed of porous concrete are respectively provided with two connecting channels, a respective one of which being connected to ambient air. Both of the other connecting channels are alternately connectible by means of a change-over valve to a supplied or drawn-in air channel or to an exhaust air channel. Moisture or dampness contained in the exhaust air condenses in the initially cooler hollow member and must be removed therefrom in a manner not disclosed in the German published application. This hollow member gradually absorbs so much thermal energy from the exhaust air and the condensate, however, that heat transfer from the exhaust air to the hollow members and condensation can barely occur. At the latest, by that time, the valve must change over, thereby connecting the other hollow member, which had been cooled by the drawn-in or supplied air in the interim, to the exhaust air channel and the heated-up hollow member to the drawn-in or supplied air channel.

In the heretofore known embodiment of the aforementioned German published application, the exhaust air is cooled down and dehumidified only very nonuniformly and incompletely. Due to the construction of the hollow members and the material used therefor, the drawn-in or supplied air is, in fact, fed back again to the part of the condensate which has been absorbed by the material of the hollow body out of the exhaust air. The drying operation can thereby last considerably longer and can consume considerably more energy than with the conventional method of condensing the moisture or dampness in a water-cooled condenser.

It is accordingly an object of the invention to provide an improved clothes dryer which affords more effective utilization of the thermal energy that is employed and which avoids any use of cooling water for drying.

With the foregoing and other objects in view, there is provided, in accordance with the invention, in a housing, a clothes dryer wherein dampness in washed clothes is expelled by warm air sweeping therethrough, the air being drawn in at least partly from the environment through openings formed in the housing and heated and, after absorbing the dampness, exhausted at least partly back into the environment, the air drawn in from the environment and exhausted to the environment being conducted through two channels of a heat exchanger with a solid-body regenerator alternatingly contacted in part by the drawn-in air and the exhausted air, non-hygroscopic storage material received in the regenerator and absorbing thermal energy as loss-free as possible, storing the absorbed thermal energy as loss-free as possible and subsequently surrendering the thermal energy as loss-free as possible, the regenerator being air-permeable in axial direction thereof and being mounted in the drawn-in and exhausted air channels for rotation in a manner that every region of the regenerator is alternatingly introduced into the drawn-in air channel and into the exhaust air channel during the rotation.

In the clothes dryer according to the invention, the condensate cannot be transported in the regenerator to the supplied or drawn-in air because it drains off beforehand due to the action of gravity. The supplied or drawn-in air therefore remains dry. It merely absorbs, in the regenerator, only the thermal energy contained in the storage material whereby a great part of the injected thermal energy is continuously kept in circulation within the dryer. Only a small part of the thermal energy escapes unavoidably with the draining condensate. The invention has the further advantage that, with continuous, slow rotation of the regenerator, a very extensive and uniform heat return by and dehumidification of the exhaust gas can be attained.

In accordance with another feature of the invention, that is of relatively simple construction and especially economical, the regenerator comprises a basket filled with the storage material.

When, further in accordance with the invention, the basket is filled with mineral granules, with ceramic filling bodies having a glazed surface or with metal as storage material or with an helical sheetmetal coil having winding cross sections disposed at an angle to be axis or shaft of the regenerator, it may be of advantage, in accordance with an added feature of the invention to provide, in the regenerator, the drawn-in or supplied and the exhaust air channels with a spacing therebetween which is greater than the lengths of drawn-in and exhaust air travel paths within the regenerator.

On the other hand, in accordance with an alternate feature of the invention, at least three partitions are disposed in the basket in a manner that, independently of the rotary position of the regenerator, no air flow from the exhaust air channel to the drawn-in or supplied air channel within the regenerator is permitted to the respective air flow in the drawn-in or supplied air channel and in the exhaust air channel.

When, in accordance with the invention, the regenerator comprises an air-permeable array of metal sheets disposed in axial direction of the regenerator, there is provided, in accordance with yet another feature of the invention, that the metal sheets are radially directed. Then, the condensate depositing on the metal sheets can drain off downwardly and be collected.

In accordance with yet a further feature of the invention, the drawn-in or supplied and the exhaust air channels have a cross-sectional area corresponding substantially to a circular sector whereby the heat exchange occurs in the greatest possible areal or spatial sector of the regenerator. All of the storage bodies of the regenerator can thereby be utilized uniformly for heat transfer.

In accordance with yet an added feature of the invention the exhaust air channel is located in a lowermost region of the regenerator, whereby the condensate draining downwardly due to the action of gravity can be discharged without special expense.

In order to afford unrestricted drainage of the condensate, in accordance with yet an additional feature of the invention, the solid bodies of which the storage material is formed have a shape and location in the regenerator for facilitating flow-off or drainage of the water condensing from the exhaust air in a direction transverse to the flow of exhaust air in the channel thereof.

In accordance with a concomitant feature of the invention, a condensate collecting vessel is disposed below the regenerator substantially in alignment with the exhaust air channel. The condensate collecting vessel can be connected, for example, to a discharge or drain line.

Other features which are considered as characteristic for the invention are set forth in the appended claims.

Although the invention is illustrated and described herein as embodied in housed clothes dryer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic vertical sectional view of a housed clothes dryer constructed in accordance with the invention;

FIGS. 2 and 3 are fragmentary diagrammatic cross-sectional views of FIG. 1 showing two different embodiments of the regenerator basket thereof;

Figure 4:
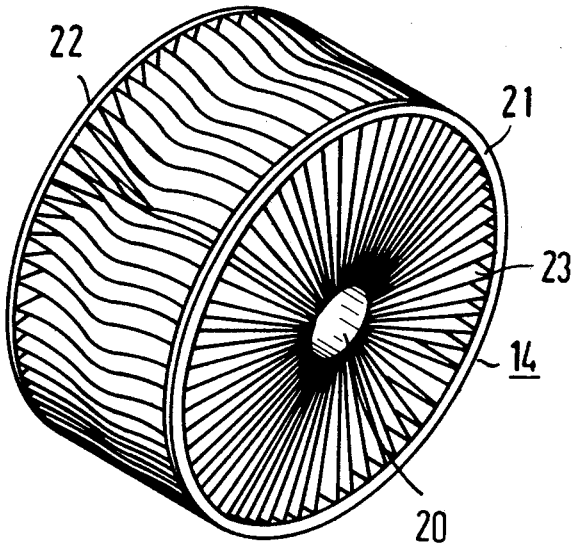
FIG. 4 is a perspective view of a regenerator equipped with radially directed metal sheets.

Referring now to the drawings and first, particularly, to FIG. 1 thereof, there is shown diagrammatically a clothes dryer enclosed by a housing 1 and having a drying chamber surrounded by a drum container 2 wherein a clothes drum 3 is mounted so as to be rotatable about a horizontal axis. The free spaces within the housing 1 that are shown with hatching are not necessary for any devices forming part of the invention and are therefore available for other non-illustrated devices of the clothes dryer. Two channels 4 and 5 terminate in the drying chamber, the channel 4 conducting supplied air heated by a conventional heating device 7 and advanced by a blower 6. Exhaust air that has become concentrated in the drying chamber with expelled moisture is discharged through the channel 5. For specific types of operation of the dryer, which are not further explained herein since they are not essential to the invention, an air circulating channel 8 connecting the channels 4 and 5 is provided and contains a valve 9 by means of which it is closable. The channel 4 is connected by an air supply channel 10 to a housing opening 11, and the channel 5 through an exhaust air channel 12 to an housing opening 13.

A regenerator 14 diagrammatically represented in vertical section in FIG. 1 is disposed in a circulatory loop that includes the supplied air and exhaust air channels 10 and 12, the regenerator 14 having a horizontal shaft 15 rotatably mounted within the housing 1 and driven at a slow rotary speed by an electrical motor 16 utilizing, if necessary or desired, a non-illustrated step-down transmission or reduction gearing. The regenerator 14 is formed primarily of a basket-like container filled with a non-hygroscopic storage material 17. This storage material 17 is supposed to absorb, free of any losses as possible, thermal energy tendered thereto, and to surrender, free of any losses as possible, thermal energy demanded therefrom. Thermal energy absorbed by the storage material should, however, remain stored as free of any losses as possible. Mineral granular material (stones or rocks), ceramic filling or packing material with glazed surfaces and metal, for example, are suitable materials for adequately satisfying the foregoing conditions.

A condensate collecting vessel 18 is provided below the exhaust air channel 12 and the regenerator 14 and is connected in an otherwise non-illustrated manner through a pump to a discharge line.

During the drying operation, the blower 6 draws in outer air through the housing opening 11, the storage material 17 and the supplied air channel 10, and conducts it over the heating member 7 and the channel 4 into the drying chamber. The air concentrated therein with expelled moisture flows through the channel 5 to the exhaust air channel 12, when the valve 9 blocks the channel 8, and then passes through the lower region of the regenerator 14 to the exhaust air opening 13. The moisture or dampness of the exhaust air condenses, when it flows through the lower region of the regenerator 14, on the comparatively cool storage material 17 and drips into the collecting vessel 18. Furthermore, the exhaust air surrenders the thermal energy contained therein to the storage material 17 and discharges at room temperature out of the opening 13 into the ambient air. During the drying operation, the regenerator 14 is continuously kept in slow rotation so that all of the regions thereof successively pass through the supplied air and exhaust air channels 10 and 12. The storage material charged with thermal energy in the exhaust air channel 12 is then directly and rapidly delivered into the supplied air channel 10 to surrender to the supplied air therein the thus stored thermal energy. The storage material is cooled to such an extent thereby that when it is again rotated into the exhaust gas channel 12, it can again condense moisture and absorb heat from the exhaust gas. Consequently, a considerable part of the thermal energy contained in the exhaust gas is again fed through the regenerator 14 to the supplied air and constantly kept in circulation in the clothes dryer.

The supplied air and exhaust air channels 11 and 12 are disposed farther apart from one another than the lengths of the supplied air and exhaust air travel paths within the regenerator 14. Therefore, greater air resistance exists between both channels 11 and 12 within the storage material 17 than in the respective supplied air or exhaust air travel paths. A flow-engineering short-circuit between the channels 11 and 12 is therefore hardly to be expected; a small fraction of secondary or auxiliary air can, by all means, even be admitted.

To prevent the flow of secondary air between the two channels 11 and 12, as shown in FIGS. 2 and 3, partitions 19 can be disposed in the basket-like container 2 of the regenerator 14 in stellar fashion about the shaft 15 thereof so as to subdivide the basket-like container 2 of the regenerator 14 into three or four chambers of equal size. The partitions 19 form resistances that are virtually unable to be overcome by short-circuit flows so that the supplied air and exhaust air channels 11 and 12 are uncoupled in the flow-engineering sense. In such a construction of the regenerator container 2, the effective cross sections of the air channels 11 and 12 can be increased to such an extent that at least one partition 19 is always located between the inlets thereof into the regenerator 14 independently of the rotary position of the regenerator container 2. If the cross sections of the inlets of the air channels 10 and 12 to the regenerator 14 are circular sector-shaped, as in the embodiments of FIGS. 2 and 3, the greatest possible cross-section surface can be attained, on the one hand, and the condensation and heat exchange in all parts of the storage material 17 can be uniformly effected, on the other hand.

The embodiment of the regenerator 14 shown in FIG. 4 is constructed of a multiplicity of radially directed metal sheets or plates 23 fastened between a shaft hub 20 and rims 21 and 22. The radial direction of the metal sheets or plates 23 minimize run-off of the condensate in the respective lower region of the regenerator 14. To intensify the contact between the air traversing the regenerator 14 and the surfaces of the metal sheets or plates 23, the latter are formed with one or more waves therein.

Figure 5:
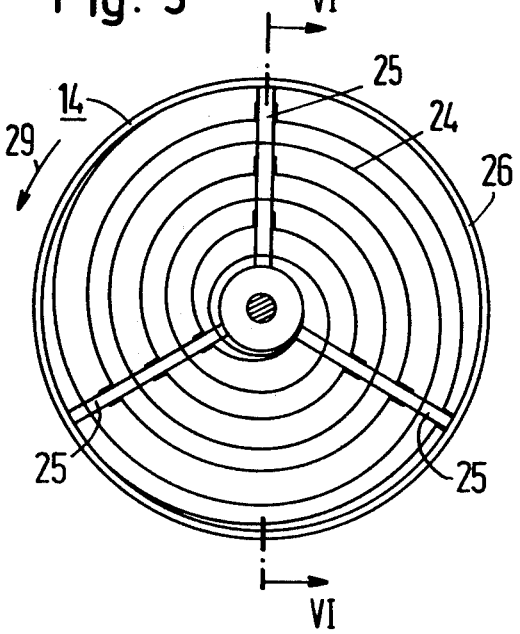
FIG. 5 is a front elevational view of FIG. 6.
Figure 6:
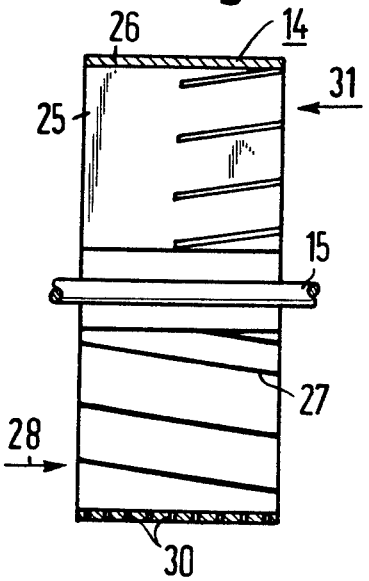
FIG. 6 is a vertical sectional view of yet another embodiment of the regenerator containing a helically wound metal sheet as storage material.

The embodiment of the regenerator 14 shown in FIGS. 5 and 6 contains an helical sheetmetal coil 24 which is retained within the casing-like basket 26 of the regenerator 14, by means of three partitions 25. The windings 27 of the sheetmetal coil 24 are disposed at an angle to the shaft 15 of the regenerator 14 in a manner that the exhaust air flowing in direction of the arrow 28 assists the run-off of the drops of condensate at the surfaces of the sheetmetal coil 24 in the same direction as that in which gravity acts. Furthermore, good run-off of the condensate can be assisted or augmented, if the regenerator 14 is rotated in direction of the curved arrow 29 (FIG. 5). Condensate run-off holes 30 are provided at least in parts of the casing or wall of the regenerator basket 26 and, if necessary or desirable, in the sheetmetal coil 24. The supplied air passes or roams through the regenerator 14 in direction of the arrow 31 (FIGS. 1 and 6). The partitions 25 can serve the same function as the partitions 19 of the embodiment of the regenerator 14 shown in FIGS. 2 and 3 in addition to providing the supporting function thereof for the windings 27 of the sheetmetal coil 24.

There are claimed:

1. In a housing, a clothes dryer wherein dampness in washed clothes is expelled by warm air sweeping therethrough, the air being drawn in at least partly from the environment through openings formed in the housing and heated and, after absorbing the dampness, exhausted at least partly back into the environment, the air drawn in from the environment and exhausted to the environment being conducted through two channels of a heat exchanger with a solid-body regenerator alternatingly contacted in part by the drawn-in air and the exhausted air, the improvement therein comprising non-hygroscopic storage material received in the regenerator and absorbing thermal energy as loss-free as possible, storing the absorbed thermal energy as loss-free as possible and subsequently surrendering the thermal energy as loss-free as possible, the regenerator being air-permeable in axial direction thereof and being mounted in the drawn-in and exhausted air channels for rotation in a manner that every region of the regenerator is alternatingly introduced into the drawn-in air channel and into the exhaust air channel during the rotation, the regenerator comprising an air-permeable array of metal sheets disposed in axial direction of the regenerator and held substantially radially symmetrically in a hollow cylinder, said metal sheets being formed of a helical sheetmetal coil having winding cross sections disposed at an angle to the axis of the regenerator.

2. Clothes dryer according to claim 1 wherein the regenerator further comprises a basket filled with said storage material.

3. Clothes dryer according to claim 2 wherein said storage material is formed of mineral granules.

4. Clothes dryer according to claim 2 wherein said storage material is formed of ceramic filling bodies having a glazed surface.

5. In a housing, a clothes dryer wherein dampness in washed clothes is expelled by warm air sweeping therethrough, the air being drawn in at least partly from the environment through openings formed in the housing and heated and, after absorbing the dampness, exhausted at least partly back into the environment, the air drawn in from the environment and exhausted to the environment being conducted through two channels of a heat exchanger with a solid-body regenerator alternatingly contacted in part by the drawn-in air and the exhausted air, the improvement therein comprising non-hygroscopic storage material received in the regenerator and absorbing thermal energy as loss-free as possible, storing the absorbed thermal energy as loss-free as possible and subsequently surrendering the thermal energy as loss-free as possible, the regenerator being air-permeable in axial direction thereof and being mounted in the drawn-in and exhausted air channels for rotation in a manner that every region of the regenerator is alternatingly introduced into the drawn-in air channel and into the exhaust air channel during the rotation, the regenerator comprising a basket filled with said storage material, drawn-in and exhaust air travel paths being defined within the regenerator, and the drawn-in and exhaust air channels being spaced apart a distance greater than the lengths of said drawn-in and exhaust air travel paths.

6. In a housing, a clothes dryer wherein dampness in washed clothes is expelled by warm air sweeping therethrough, the air being drawn in at least partly from the environment through openings formed in the housing and heated and, after absorbing the dampness, exhausted at least partly back into the environment, the air drawn in from the environment and exhausted to the environment being conducted through two channels of a heat exchanger with a solid-body regenerator alternatingly contacted in part by the drawn-in air and the exhausted air, the improvement therein comprising non-hygroscopic storage material received in the regenerator and absorbing thermal energy as loss-free as possible, storing the absorbed thermal energy as loss-free as possible and subsequently surrendering the thermal energy as loss-free as possible, the regenerator being air-permeable in axial direction thereof and being mounted in the drawn-in and exhausted air channels for rotation in a manner that every region of the regenerator is alternatingly introduced into the drawn-in air channel and into the exhaust air channel during the rotation, the regenerator comprising a basket filled with said storage material, and including at least three partitions disposed in said basket in a manner that, independently of the rotary position of the regenerator, all air flow from the exhaust air channel to the drawn-in air channel within the regenerator is blocked from the respective air flow in the drawn-in air channel and in the exhaust air channel.

7. Clothes dryer according to claim 5 or 6 wherein said storage material is formed of metal.

8. Clothes dryer according to claim 5 or 6 wherein the regenerator comprises an air-permeable array of metal sheets disposed in axial direction of the regenerator and held substantially radially symmetrically in a hollow cylinder.

9. Clothes dryer according to claim 8 wherein said metal sheets are radially directed.

10. Clothes dryer according to claim 6 wherein said drawn-in and exhaust air channels have a cross-sectional area corresponding substantially to a circular sector.

11. Clothes dryer according to claim 1, 5 or 6 wherein said exhaust air channel is located in a lowermost region of the regenerator.

12. Clothes dryer according to claim 11 wherein said storage material is formed of solid bodies having a shape and location in the regenerator for assisting in a flow-off of water condensing from the exhaust air in a direction transverse to the flow of exhaust air in said channel thereof.

13. Clothes dryer according to claim 12 including a condensate collecting vessel disposed below the regenerator substantially in alignment with the exhaust air channel.

* * * * *